US006305667B1

(12) United States Patent
Heller

(10) Patent No.: US 6,305,667 B1
(45) Date of Patent: Oct. 23, 2001

(54) LIFTING DEVICE FOR LIFTING HEAVY LOADS, IN PARTICULAR DERAILED RAIL VEHICLES

(75) Inventor: Heinz Heller, Erlangen (DE)

(73) Assignee: Lukas Hydraulik GmbH & Co. KG, Erlangen (DE)

( * ) Notice: Subject to any disclaimer, the term of this patent is extended or adjusted under 35 U.S.C. 154(b) by 0 days.

(21) Appl. No.: 09/272,019

(22) Filed: Mar. 18, 1999

(30) Foreign Application Priority Data

Mar. 23, 1998 (DE) ..... 198 12 472

(51) Int. Cl.[7] ..... B66F 3/24

(52) U.S. Cl. ..... 254/93 R; 254/423; 254/89 H; 254/93 H

(58) Field of Search ..... 254/93 R, 89 H, 254/93 H, 423, 93 L

(56) References Cited

U.S. PATENT DOCUMENTS

| | | | | |
|---|---|---|---|---|
| 2,795,934 | * | 6/1957 | Jenkins | 254/93 R |
| 2,803,224 | * | 8/1957 | Wilson | 254/93 R |
| 3,145,693 | * | 8/1964 | Groetschel | 254/93 R |
| 3,628,637 | * | 12/1971 | Axthammer | 254/93 R |
| 3,731,487 | | 5/1973 | Beyer et al. . | |
| 3,743,248 | * | 7/1973 | Moor | 254/93 R |
| 3,831,901 | * | 8/1974 | Williams et al. | 254/93 R |
| 4,623,125 | * | 11/1986 | Ebey | 254/420 |
| 4,921,269 | * | 5/1990 | Scully | 254/420 |
| 5,011,119 | * | 4/1991 | Harrington | 254/420 |
| 5,181,693 | * | 1/1993 | Lorenz | 254/93 R |
| 5,810,333 | * | 9/1998 | Hickerson et al. | 254/93 R |

FOREIGN PATENT DOCUMENTS

| | | |
|---|---|---|
| 35 45 110 A 1 | 6/1986 | (DE) . |
| 197 00 025 A 1 | 7/1997 | (DE) . |
| 0 717 199 A 1 | 6/1996 | (EP) . |

OTHER PUBLICATIONS

Lukas—Kompakt–Aufgleisanlage Compact Rerailing System Nov. 1998.*
Search Report dated Aug. 25, 1999.

* cited by examiner

*Primary Examiner*—Timothy V. Eley
*Assistant Examiner*—Lee Wilson
(74) *Attorney, Agent, or Firm*—Merchant & Gould P.C.

(57) ABSTRACT

The invention relates to a lifting device for lifting heavy loads, e.g. derailed rail vehicles, for permanent or temporary installation, having at least one cylinder, in particular hydraulic cylinder, for actuating a mechanical ram, in which device cylinder 2 and ram 3 are separate from one another and the ram 3 is accommodated in a guide tube 4.

18 Claims, 1 Drawing Sheet

LIFTING DEVICE FOR LIFTING HEAVY LOADS, IN PARTICULAR DERAILED RAIL VEHICLES

FIELD

The invention relates to a lifting device for lifting heavy loads, e.g. derailed rail vehicles, for permanent or temporary installation, having at least one cylinder, in particular hydraulic cylinder, for actuating a mechanical ram. In concrete terms, the present invention relates to a so-called "internal jack".

BACKGROUND

Vehicles (e.g. trams, underground trains, etc.) which, in the event of derailment, are impossible to lift and/or move from outside the derailed vehicle (e.g. when in tunnels) are recovered using so-called "internal jacks". Internal jacks are understood to mean lifting devices which are fitted permanently or temporarily in the floor area in the interior of the vehicle and by means of which recovery measures can be carried out from outside even where accessibility is extremely restricted. Known internal jacks are designed as single-acting hydraulic cylinders or telescopic cylinders which are generally attached in the floor of the vehicle. Therefore, a floor sleeve provided for this purpose is arranged on the vehicle. The cylinder is installed head-first in this floor sleeve. In operation, the piston rod, when actuated, extends downwards and lifts the vehicle body so that it can then be moved.

In low-floor vehicles, which are now being used to an increasing extent, suitable installation of the internal jacks is becoming more and more difficult due to the restricted space available.

SUMMARY

The object of the present invention consists in providing a lifting device which can be used for low-floor vehicles and, at the same time, has a high level of safety against buckling and flexural load-bearing capacity combined with perfect running.

This object is achieved, in the lifting device of the generic type, by the fact that cylinder and ram are separated from one another and the ram is accommodated in a guide tube. The invention makes it possible to achieve a lifting device which provides sufficient force and very stable guidance in the area of the ram and which can be accommodated in particular in the outer wall area of low-floor vehicles.

Advantageously, the ram is designed as a hollow ram. This firstly reduces its weight and secondly simplifies fitting of the ram. On the other hand, the strength of the ram is maintained.

The tool insert, which may in particular be designed as an exchangeable tool insert, is situated at the front end of the hollow ram.

To attach the lifting device to the vehicle, the guide tube comprises a catch, in particular a bayonet catch. The catch is advantageously situated in the floor area of the vehicle.

According to a further configuration of the present invention, cylinder and ram are connected to one another in an articulated manner. This prevents elastic distortions in use from being transmitted from the ram area to the cylinder area, where they would lead to damage to the running faces or seals.

Such an articulated connection can be produced in a particularly simple manner by using a ball socket and ball cap in the area of the contact face between ram and piston rod of the cylinder.

Advantageously, the articulated movement of ram with respect to piston rod is spring-loaded, specifically, by way of example, by means of at least one spring element which is provided between cylinder and ram and may be designed as a spring element which acts in the axial direction.

According to a further configuration of the present invention, the ram and the piston rod of the cylinder can be connected to one another by means of a threaded bolt which can be introduced axially via the inside of the hollow ram.

Furthermore, according to a refinement of the invention, a holding ring, e.g. in the form of a clasp nut, is provided in the area of the connection between piston rod and ram. The holding ring holds together the area where the piston rod of the cylinder and the guide tube meet. To avoid adverse effects from dirt, a seal is provided between holding ring and cylinder. The seal has the further advantage that the ram cannot itself be rotated with respect to the cylinder in the load-free state as a result of slight shaking, and therefore the connection between holding tube and vehicle cannot be released unintentionally.

The holding ring is designed or dimensioned in such a way that it allows a pivoting movement of the ram, including guide tube, with respect to the cylinder.

The outer sides of the cylinder and of the holding ring are expediently aligned, so that the diameter of the cylinder is not exceeded, thus ensuring problem-free installation.

Furthermore, it is possible, in particular in the case of a lifting device which remains permanently on the vehicle, to provide a securing device for fixing the position of cylinder and/or ram.

The securing device used is, for example, at least one securing pin in the area of the cylinder and/or ram and/or holding ring. The securing pin may in this case advantageously be arranged so as to run in the radial direction.

The lifting device according to the invention is very particularly suitable for installation in the outer wall area of the vehicle, in particular, for example, in the section column of the outer wall. The locking position of the lifting device is preferably provided in the floor area of the vehicle.

BRIEF DESCRIPTION OF THE DRAWINGS

An expedient configuration of the present invention is explained in more detail with reference to the drawings, in which.

DETAILED DESCRIPTION

Figure 1:
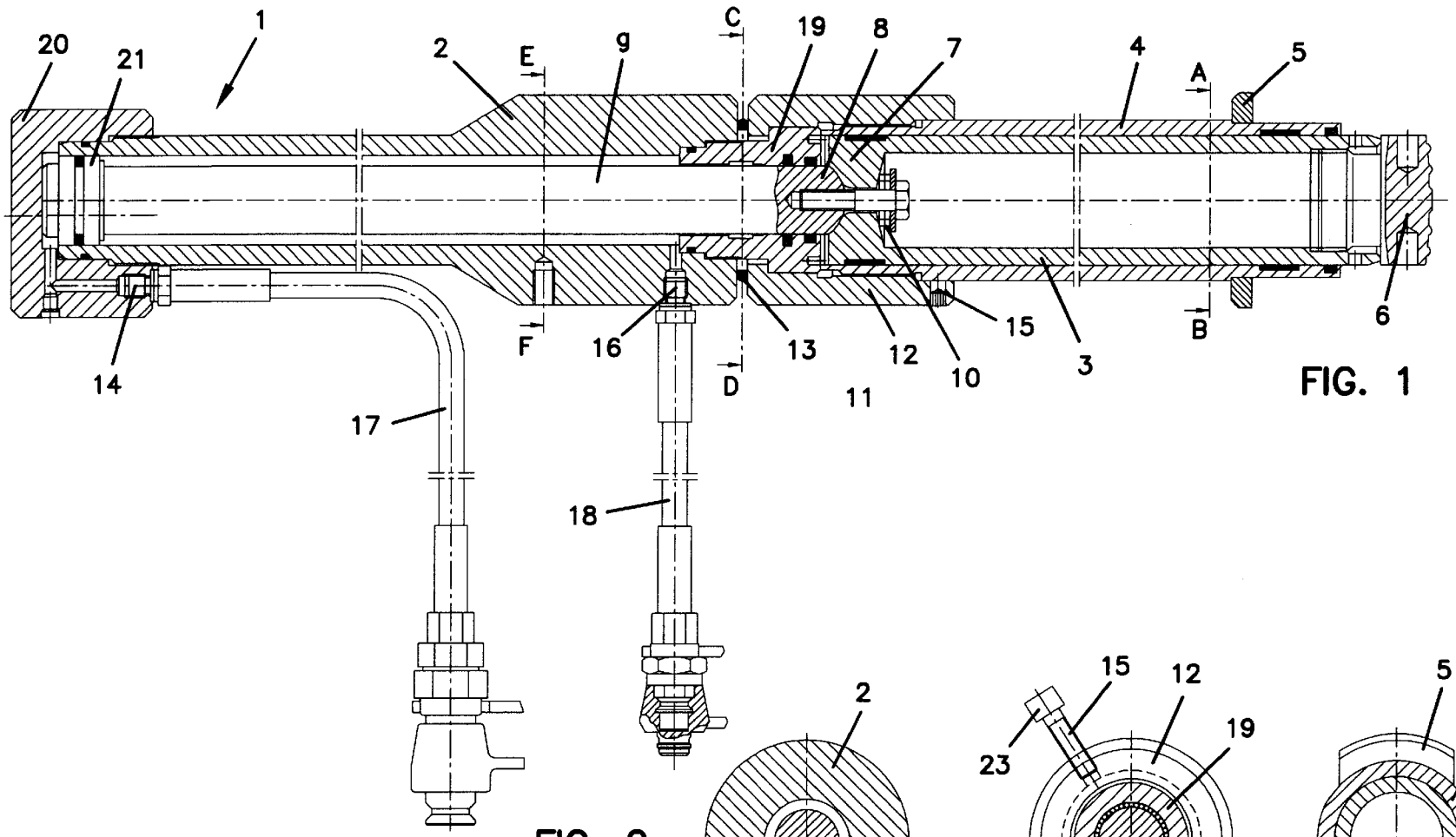
FIG. 1 shows a sectional illustration through the lifting device according to the present invention.

In FIG. 1, reference numeral 1 denotes the lifting device, e.g. a so-called "internal jack", in its entirety. The lifting device 1 comprises a cylinder 2 with a piston rod 9 which is guided in the cylinder 2 by means of a piston 21. The piston rod 9 runs in a guide part 19 at the widened end of the cylinder 2. On the opposite side, there is a closure cover 20 and a connection, which is provided in the closure cover 20, with a hydraulic hose 17 and quick-fitting coupling 14. A corresponding quick-fitting coupling 16 is also provided in the widened area of the cylinder 2, for connection to a hydraulic hose 18.

The hydraulic hoses 17, 18 are connected to a reversing valve and a pump with reservoir, which are not shown in FIG. 1.

According to the present invention, cylinder 2 and ram 3 are formed separately from one another. To this end, a ram, in the form of a hollow ram, is provided an is guided in a guide tube 4. A holding ring, in particular in the form of a clasp nut 12, is situated on the outer side of the guide part 19 and adjoining guide tube 4.

Piston rod 9 and ram 3 are connected to one another by means of a threaded bolt which is arranged centrally, with a spring element 10, which acts in the axial direction, interposed between them. In addition, at is end side the piston rod 9 is designed as a ball cap 8 and the adjoining end side of the ram 3 is designed as a ball socket 7, with the result that ram 3 can be pivoted to a certain extent with respect to piston rod 2. The holding ring is in this case to be designed in such a way that it allows a certain degree of pivoting of ram 3, guide tube 4 and cylinder 2.

In its end area facing towards the ram 3, the cylinder 2 has a widened diameter which, in this area, corresponds to the diameter of the holding ring or of the clasp nut 12. The ram 3 is guided in a guide tube 4. A catch, in particular bayonet catch 5, is situated on the guide tube 4 for the purpose of locking the guide tube 4 in the floor area of a vehicle (not shown).

An encircling seal 13, in the form of an O-ring seal, is situated between the widened area of the cylinder 2 and the holding ring, which seal ensures that it is impossible for any dirt to pass between cylinder and holding ring. Furthermore, the seal 13 has the additional function of ensuring that the ram 3, including guide tube 4, cannot itself rotate with respect to the cylinder 2 in the load-free state as a result of slight shaking, and as a result the bayonet locking on the bayonet catch 5 cannot be released when this is not desired.

According to the invention, the piston rod 9 and the ram 3 are connected to one another in an articulated manner, specifically, by way of example, by means of a ball cap 8 which is provided in the area of the contact face between piston rod 9 and ram 3 and interacts with a ball socket 7. Piston rod 9 and ram 3 are connected to one another by means of a threaded bolt 11 which can be screwed in axially. In addition, the threaded bolt 11 acts on an axial spring element 10. In order to ensure articulated mobility of the ram 3 with respect to the piston rod 9, the hole for the threaded bolt 11 is oversized in the area of the ram 3.

Furthermore, the clasp nut 12 is likewise dimensioned in such a way that it allows the ram 3 to pivot with respect to the piston rod 9. An individually exchangeable tool insert 6 is situated on the front side of the ram 3. The securing pin 15 prevents any rotation between clasp nut 12 and guide tube 4.

Figure 2:
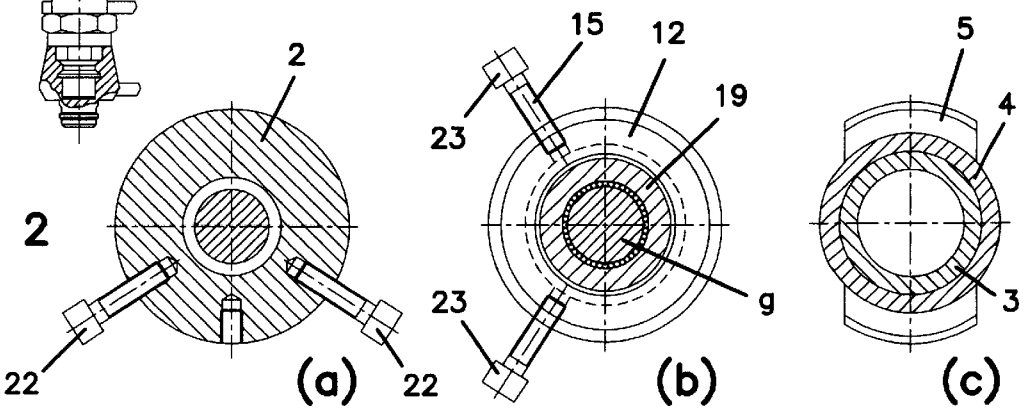
FIG. 2*a* shows a sectional illustration on line E–F in FIG. 1.
FIG. 2*b* shows a sectional illustration on line C–D.
FIG. 2*c* shows a sectional illustration on line A–B in FIG. 1.

FIG. 2*a* shows the arrangement of two securing pins 22 in the area of the widened part of the cylinder 2 (cf. in this respect FIG. 2*a*). Furthermore, two securing pins 23 are also provided in the area of the ram 3 (cf. FIG. 2*b*), with the result that the two components, which according to the invention are separate from one another, are secured in position even in the event of vibration, preventing them from becoming detached of their own accord.

FIG. 2*c* shows the design of the bayonet catch 5 for fixing the position of the ram 3 on the vehicle.

The lifting device 1 according to the invention is expediently fitted head-first in the outer wall area 1, in particular in the area of the section column of the outer wall, and the guide tube 4 of the ram 3 is coupled, at the bayonet catch 5, to the bayonet socket of the vehicle.

The invention makes it possible to use lifting devices, in particular so-called "internal jacks", on rail vehicles where there is only a very limited amount of space at the bottom (low-floor vehicles) without having to accept any reduction in the stability of the lifting device.

LIST OF REFERENCE NUMERALS

1 Lifting device
2 Cylinder
3 Ram
4 Guide tube
5 Bayonet catch
6 Tool insert
7 Ball socket
8 Ball cap
9 Piston rod
10 Spring element
11 Threaded bolt
12 Clasp nut
13 Seal
14 Quick-fitting coupling
15 Securing pin
16 Quick-fitting coupling
17 Hydraulic hose
18 Hydraulic hose
19 Guide part
20 Closure cover
21 Piston
22 Securing pin
23 Securing pin

What is claimed is:

1. Lifting device for lifting heavy loads, said lifting device comprising a mechanical ram, at least one cylinder suitable for actuating the ram, a connection connecting the ram and the at least one cylinder, and a guide tube accommodating the ram, and mounting means suitable for mounting said lifting device on a vehicle, wherein the connection is an articulated connection, such that a pivoting movement of the ram and the guide tube with respect to the cylinder is enabled.

2. Lifting device according to claim 1, wherein the ram is a hollow ram.

3. Lifting device according to claim 1, wherein the ram has a tool insert.

4. Lifting device according to claim 1, wherein the mounting means comprise a catch.

5. Lifting device according to claim 1, wherein said connection comprises a ball socket and a ball cap.

6. Lifting device according to claim 5, wherein the connection further comprises a threaded bolt connecting the ram and the piston rod axially via the inside of the ram.

7. Lifting device according to claim 5, further comprising a holding ring proximate the connection.

8. Lifting device according to claim 7, wherein the holding ring is a clasp nut.

9. Lifting device according to claim 7, further comprising a seal between the holding ring and the cylinder.

10. Lifting device according to claim 7, wherein the respective outer sides of the cylinder and holding ring are aligned with one another in the area of the connection.

11. Lifting device according to claim 1, further comprising at least one spring element between the cylinder and the ram, whereby said at least one spring element biases the cylinder and the ram apart from one another.

12. Lifting device according to claim 1, further comprising a securing device for fixing the position of the cylinder relative to the ram.

13. Lifting device according to claim 12, wherein the securing device is a securing pin, said securing pin being located on one of the the cylinder, the ram, and the holding ring.

14. Lifting device according to claim 1, wherein the lifting device is suitable for installation in the outer wall area of the vehicle.

15. Lifting device according to claim 1, wherein the locking position of the lifting device and the vehicle is provided in a floor area of the vehicle.

16. Lifting device according to claim 1, wherein the cylinder is a hydraulic cylinder.

17. Lifting device according to claim 1, wherein the mounting means are a bayonet catch.

18. Lifting device according to claim 1, wherein the mounting means are removable mounting means suitable for temporarily mounting said lifting device on the vehicle.

* * * * *